US005416504A

United States Patent [19]

Ohashi

[11] Patent Number: 5,416,504

[45] Date of Patent: May 16, 1995

[54] SEMICONDUCTOR LASER CONTROL APPARATUS

[75] Inventor: Tsuyoshi Ohashi, Hashima, Japan

[73] Assignee: Brother Kogyo Kabushiki Kaisha, Nagoya, Japan

[21] Appl. No.: 957,869

[22] Filed: Oct. 8, 1992

[30] Foreign Application Priority Data

Oct. 14, 1991 [JP] Japan ..... 3-264790

[51] Int. Cl.[6] ..... B41J 2/438

[52] U.S. Cl. ..... 347/247

[58] Field of Search ..... 346/1.1, 762, 108, 160; 372/31, 29, 38

[56] References Cited

U.S. PATENT DOCUMENTS 4,916,706 4/1990 Ohashi ..... 372/31

5,151,910 9/1992 Inuyama et al. ..... 372/31

*Primary Examiner*—Mark J. Reinhart

*Attorney, Agent, or Firm*—Oliff & Berridge

[57] ABSTRACT

A image exposure device which can generate a high-quality image by being able to arrive at a predetermined light beam strength promptly after the laser begins emitting, by setting the initial drive current which corresponds to the threshold current of the semiconductor laser element and further stabilizing is provided.

12 Claims, 8 Drawing Sheets

SEMICONDUCTOR LASER CONTROL APPARATUS

BACKGROUND OF INVENTION

1. Field of the invention

The present invention relates to an image exposure apparatus, and more particularly, to an image exposure apparatus having a semiconductor laser drive circuit which stabilizes the light output of a semiconductor laser element.

2. Description of the Prior Art

In a conventional image exposure apparatus, a photosensitive body is scanned and exposed by a laser light beam emitted from a semiconductor laser and the laser beam is modulated based on an image signal. The semiconductor laser has a characteristic that the laser beam is emitted when a driving current is applied which is over a threshold level. The intensity of the laser beam can vary significantly due to fluctuations in the threshold current level, as shown in FIG. 8. These fluctuations are caused in part by changes in the ambient temperature and occur over time, in part by inherent variations in the temperature response of each individual laser element and in part by age deterioration effects. Therefore, the intensity of the laser beam will vary over time even when being driven at a constant threshold current level. This stability in the laser light beam intensity causes blurring and a collapsed image shape. Consequently the image quality is greatly deteriorated. Therefore, the strength of the laser light beam to be output by the output control device of the image exposure apparatus must be stabilized in an environment where changes occur in the ambient temperatures of the semiconductor laser element, where individual laser elements have slightly varying response curves, and where the response curve of the laser element changes as the laser element ages.

In the prior art apparatus, the strength of laser light is stabilized in the following manner. After adding a threshold current as an offset current to a modulated signal, the drive circuit drives the semiconductor laser element by the added modulated signal. When the laser light beam is not scanning the photosensitive drum, a monitor circuit monitors the output of the semiconductor laser to provide a feedback signal to the drive circuit in order to control the offset current.

However, the semiconductor laser element has the characteristic that it is easy to destroy the semiconductor if the driving current should become much greater than the threshold current level. This overcurrent should be kept as close as possible to the threshold current level. Therefore, this prior art apparatus controls the drive current conventionally so that it provides the semiconductor laser element with a drive current which is just large enough to cause the laser element to begin emitting. Considering the difference of the semiconductor laser element and the range of environmental temperature, the drive current is increased gradually to generate a predetermined light strength in the laser device. The predetermined light strength is determined when the semiconductor laser element has just begun emitting.

Therefore, the prior art apparatus has a disadvantage that it has to cause the semiconductor laser element to emit sufficiently in advance of scanning, because it takes a long time to stabilized the strength of laser light beam under some circumstances. Moreover, the gain of the control loop cannot be excessively enlarged to ameliorate the above-mentioned problem, because the image quality is occasionally ruined. Also, if the gain of the above-mentioned control loop is enlarged, the above disadvantage is solved but the control in the image exposure area becomes unstable in some respects, such as the over contact heat characteristic. Therefore, determining the gain of the control loop was very difficult.

SUMMARY OF THE INVENTION

It is therefore an object of the present invention to overcome the above-described disadvantages of prior art and to provide an image exposure device which can generate a high-quality image, promptly arrives at a predetermined light strength after the semiconductor laser element begins emitting, and stabilizes the strength of laser light beam. In carrying out the invention and according to one aspect thereof, there is provided an image exposure apparatus comprising a semiconductor laser element; driving means for driving said semiconductor laser element based on a image signal; a photosensitive body to be scanned by a modulated laser beam emitted by said semiconductor laser element to generate an image corresponding to said image signal; driving control means for driving said driving means based on a monitor circuit, said monitor circuit monitoring the laser beam output from said semiconductor laser element during the time when said laser beam doesn't scan a area of image formation of said photosensitive body; said driving control means furthermore comprising a setting means for setting an initial value of said driving means for driving said semiconductor laser element to the threshold of semiconductor laser element.

In the image exposure device of the present invention which has the above-mentioned construction, the image is exposed on the photosensitive body by the emitted laser beam, which is modulated according to the image signal.

Moreover, when the semiconductor laser element begins emitting, an initial value of the drive current which drives the semiconductor laser element is the same as the threshold current of the semiconductor laser element.

The control means controls the drive circuit of said semiconductor laser element based on the initial value.

Moreover, the difference between the threshold current of the semiconductor laser element and the initial value of the drive current is very small. Therefore, the strength of laser beam reaches the predetermined light strength in a short time, even in case of a semiconductor laser element having a high threshold current.

BRIEF DESCRIPTION OF THE DRAWINGS

The invention will be described in detail with reference to the following figures, wherein.

DETAILED DESCRIPTION OF THE PREFERRED EMBODIMENT

A first preferred embodiment of the invention will now be described with reference to the accompanying drawings.

Figure 1:
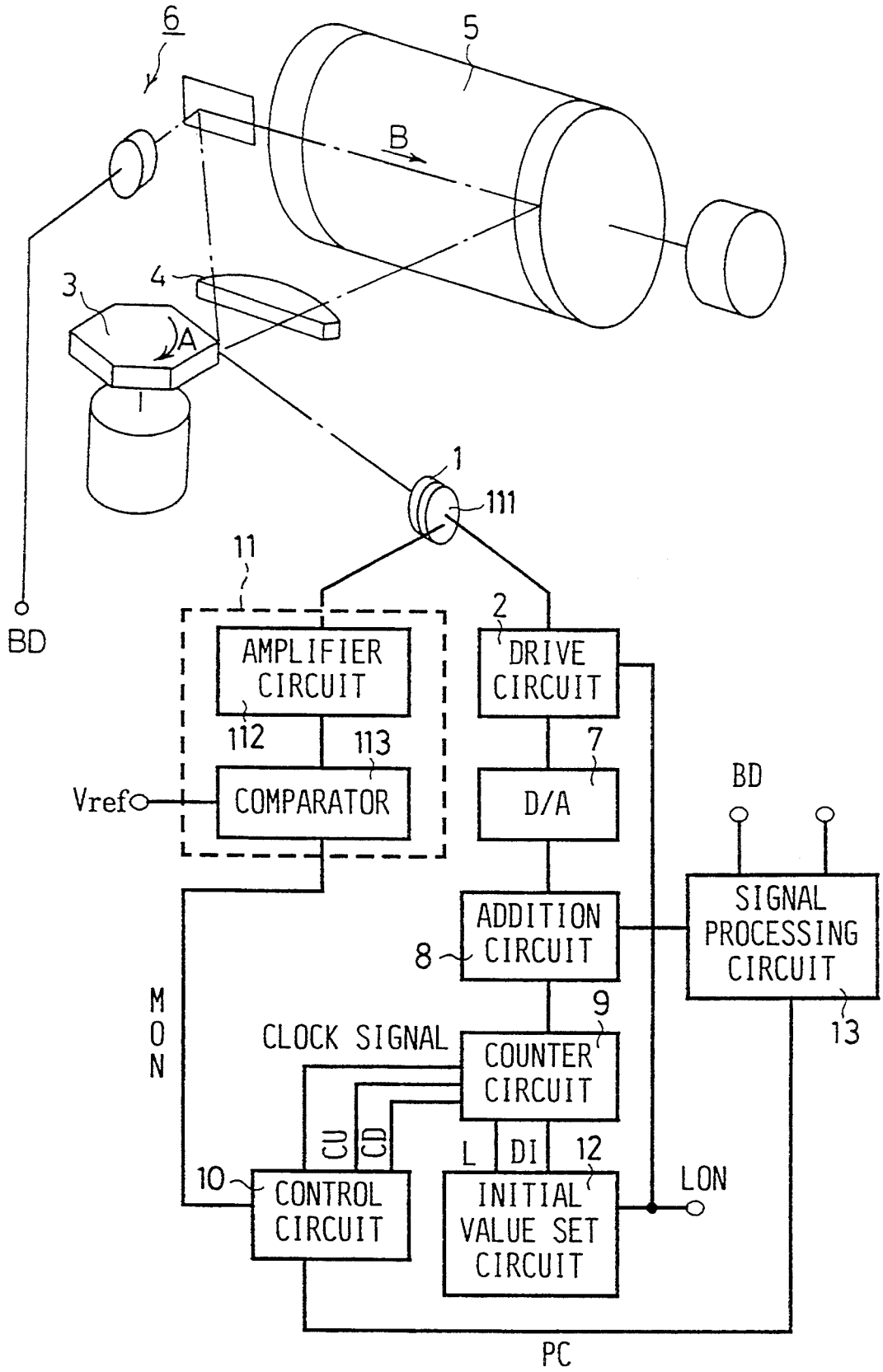
FIG. 1 is a schematic illustration which shows the construction of a suitable laser beam printer.

The image exposure apparatus, for example a laser beam printer, has a semiconductor laser element 1, as shown in FIG. 1, as a light source and a drive circuit 2 connected to the semiconductor laser element which drives the semiconductor laser element 1.

A collimator lens (not shown) and a polygonal mirror 3 rotating in the direction A of FIG. 1 and a f-$\theta$ lens 4 cause the laser beam to move at an isometric speed to scan the surface of a photosensitive drum 5 are disposed sequentially in the optical path of the laser light beam emitted by the semiconductor laser element.

A beam detector 6, which generates a beam detection signal at each scan before the laser beam scans the photosensitive drum 5, is located close to the photosensitive drum 5 in an out-of-image area of the photosensitive drum in which image information is not written down.

An oscillation circuit is built into the beam detection device 6, such that an oscillation or clock signal is output as a beam detect signal (BD signal) when the laser beam cannot be detected by the beam detection device 6. This occurs when the intensity of the laser beam is too low to be detected, usually immediately after the laser starts emitting.

Furthermore, the laser beam printer comprises a D/A converter 7, a addition circuit 8, a counter circuit 9, a light monitor circuit 11, a initial value set circuit 12, a control circuit 10 and a signal processing circuit 13.

Figure 3:
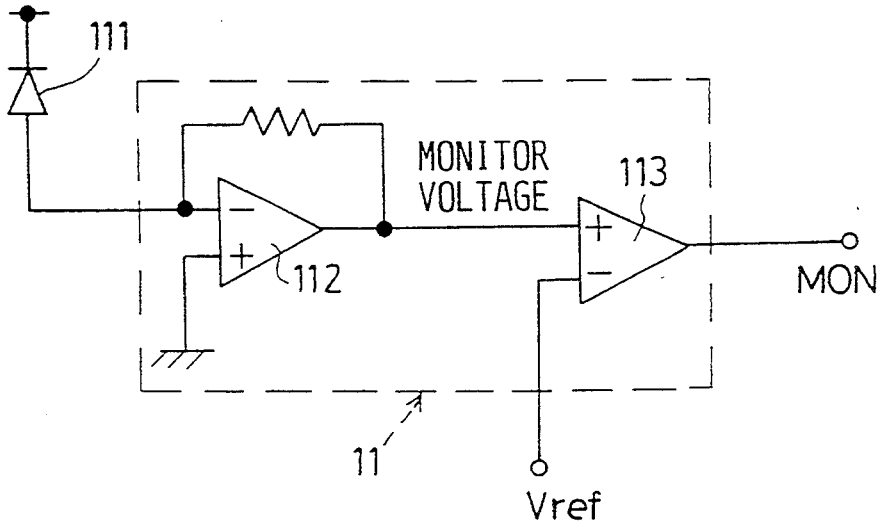
FIG. 3 is a circuit chart showing the construction of the light monitor circuit.

As shown in FIG. 3, the light monitor circuit 11 comprises a monitor diode 111 which receives the laser beam emitted in the back direction, a amplifier circuit 112 which amplifies the voltage of the output signal of the monitor diode 111 and a comparator 113 which compares the voltage of the amplified output signal of the monitor diode 111 with a reference voltage.

Figure 7:
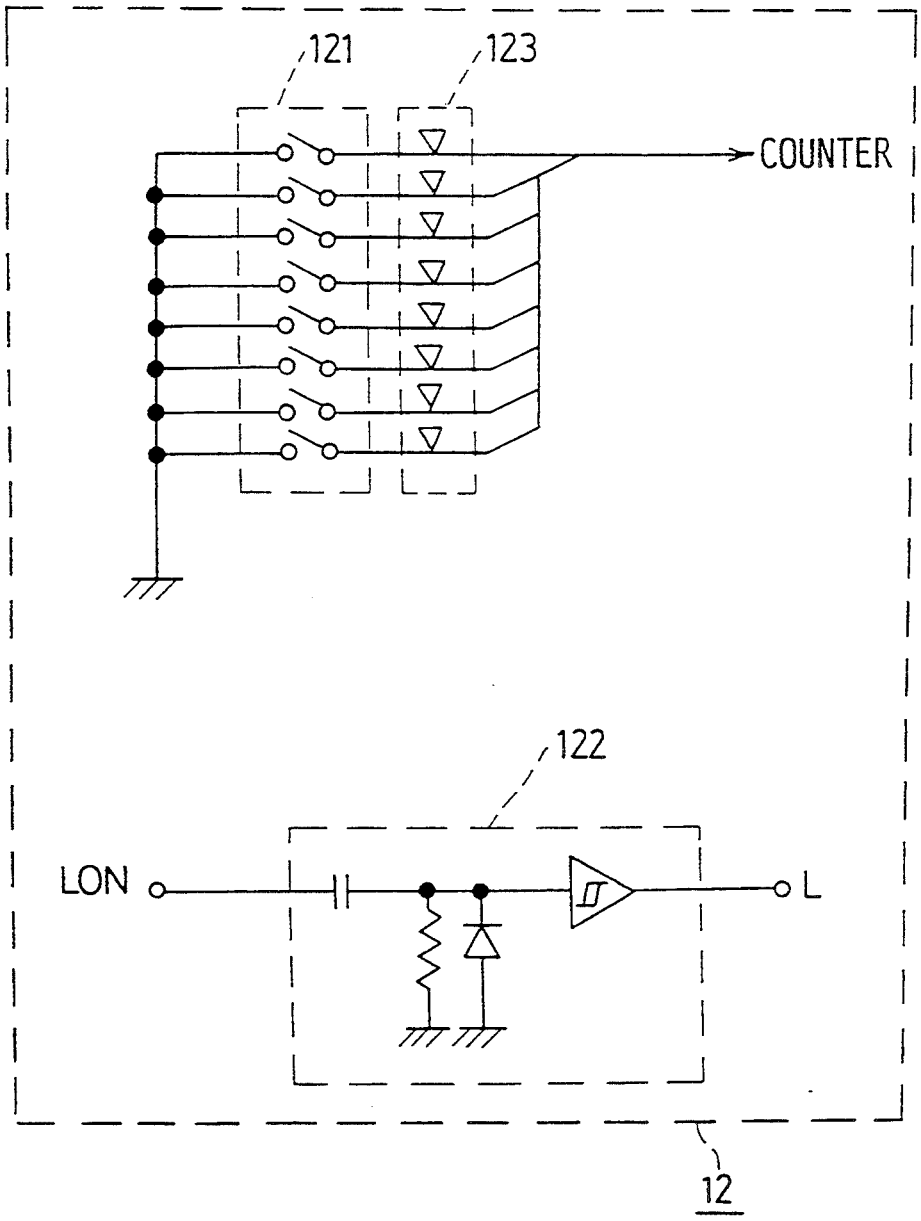
FIG. 7 is a circuit chart showing the construction of the initial value set circuit.
Figure 8:
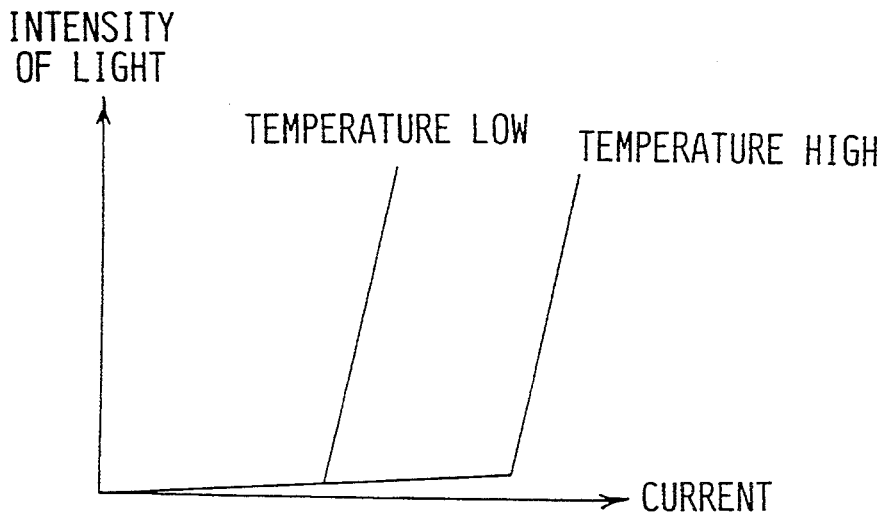
FIG. 8 shows the temperature-current response curve of a semiconductor laser element.

As shown in FIG. 7, the initial value set circuit 12 comprises a dip switch 121, differentiation circuit 122, and pull-up resistor circuit 123.

The Laser Light On signal (LON signal) is input to the differentiation circuit 122. Differentiation circuit 122 differentiates the LON signal and outputs it to the counter circuit 9 as a loading signal (L signal). Moreover, the dip switch 121 is connected to counter circuit 9 through the pull-up resistor circuit 123 and the value set into dip switch 121 is input to the counter circuit 9 as an initial value data (DI) by the loading signal L. Dip switch 121 is preset according to the threshold current response of the particular semiconductor laser element 1 used in the image exposure apparatus.

Figure 6:
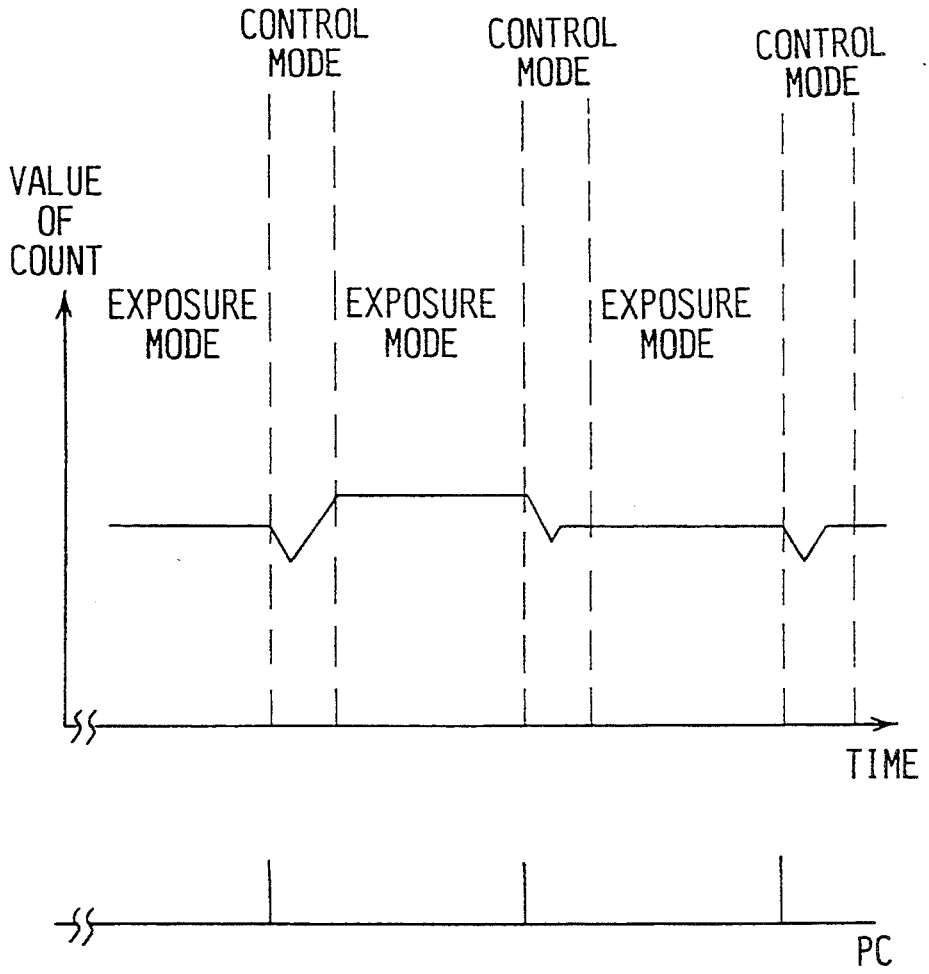
FIG. 6 shows the change of the count value of the count circuit at the exposure mode and the control mode.

The signal processing response circuit 13 distinguishes the photosensitive body scanning period when the photosensitive drum 5 is being scanned by the laser beam (hereinafter called "the expose mode") and the photosensitive body non-scanning period when the photosensitive drum 5 is not being scanned by the laser beam (hereinafter called "the control mode") by the beam detect signal BD generated by the beam detector 8. In the expose mode, the signal processing circuit 13 sends image data to the addition circuit 8 as a modulation signal, while in the control mode the processing circuit 13 sends the light strength set signal to the addition circuit 8 as the modulation signal. Moreover, in the control mode, the processing circuit 13 outputs a light strength control signal (PC signal). The PC signal starts the control circuit 10, which begins adjusting the light strength of the laser beam. That is, the exposure mode and the control mode of each scan are alternately enabled, as shown in FIG. 6.

The count value of counter circuit 9 corresponds to the offset current, and the addition circuit 8 adds the count value of counter circuit 9 to the modulation signal or the light strength set signal and outputs the sum to D/A converter 7.

The drive circuit 2 drives the semiconductor laser element 1 by the signal converted by the D/A converter 7.

In the light monitor circuit 11, as shown in FIG. 3, the laser beam emitted by the semiconductor laser element 1 on its back side is input to the monitor diode 111. The monitor diode 111 outputs a monitor current in proportion to the light strength of the laser beam. After the monitor current is amplified and converted to a monitor voltage by amplification circuit 112, the monitor voltage is compared by the comparator 113 with a reference voltage (Vref).

Figure 2:
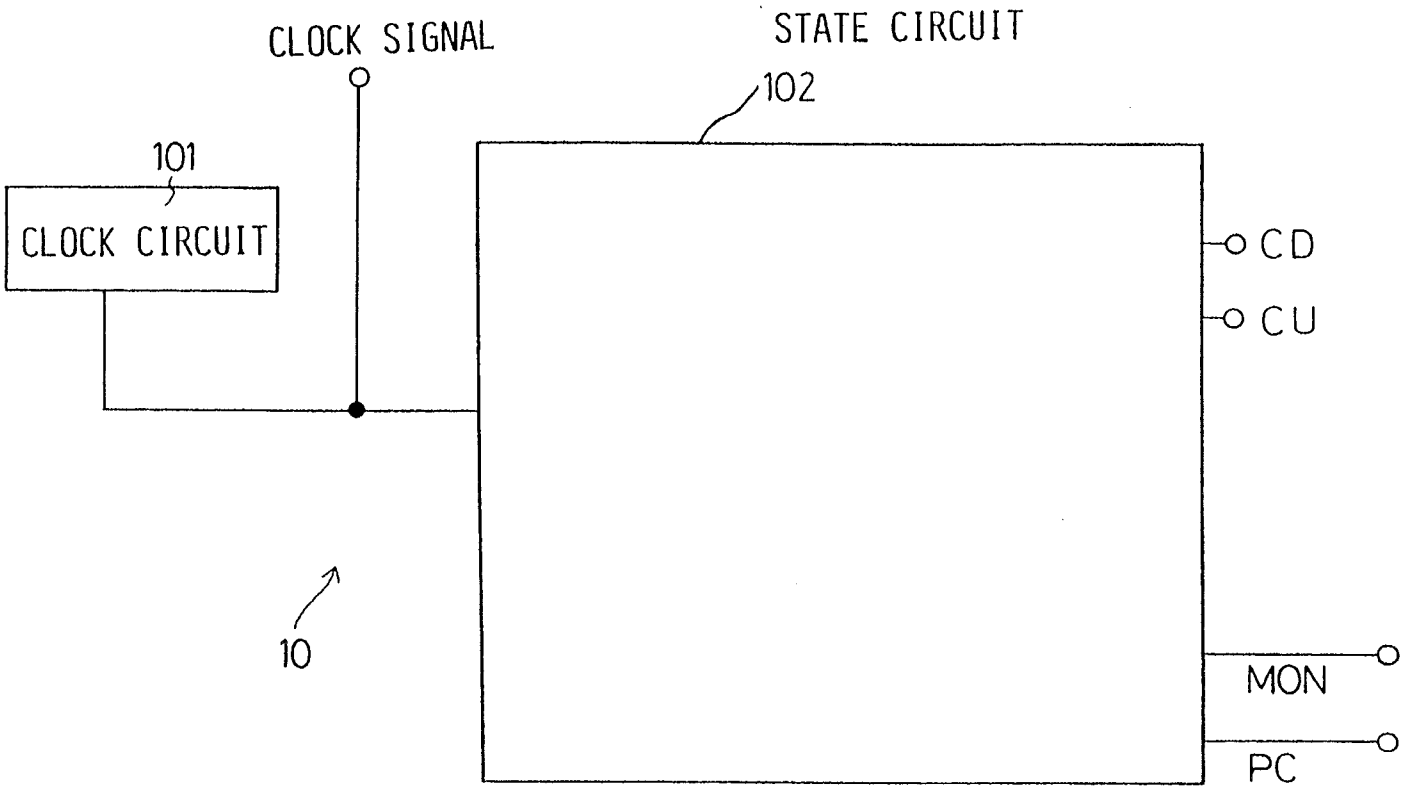
FIG. 2 is a block diagram which shows the construction of the control circuit.

The comparator 113 outputs the monitor signal (MON signal) to the control circuit 10 when the monitor voltage is larger than reference voltage (Vref). The output of the comparator 113 indicates that the light strength of the laser beam has reached the light strength corresponding to a light strength set signal. The control circuit 10 operates to keep constant the relation between the image signal and the light strength. As shown in FIG. 2, the control circuit 10 comprises a clock circuit 101 which outputs a clock signal and a state circuit 102 which counts the output of clock circuit 101, decodes this count and outputs a countdown signal (CD signal) or a countup signal (CU signal).

This state circuit 102 starts count-up and countdown signals after being reset by inputting the PC signal.

Figure 4:
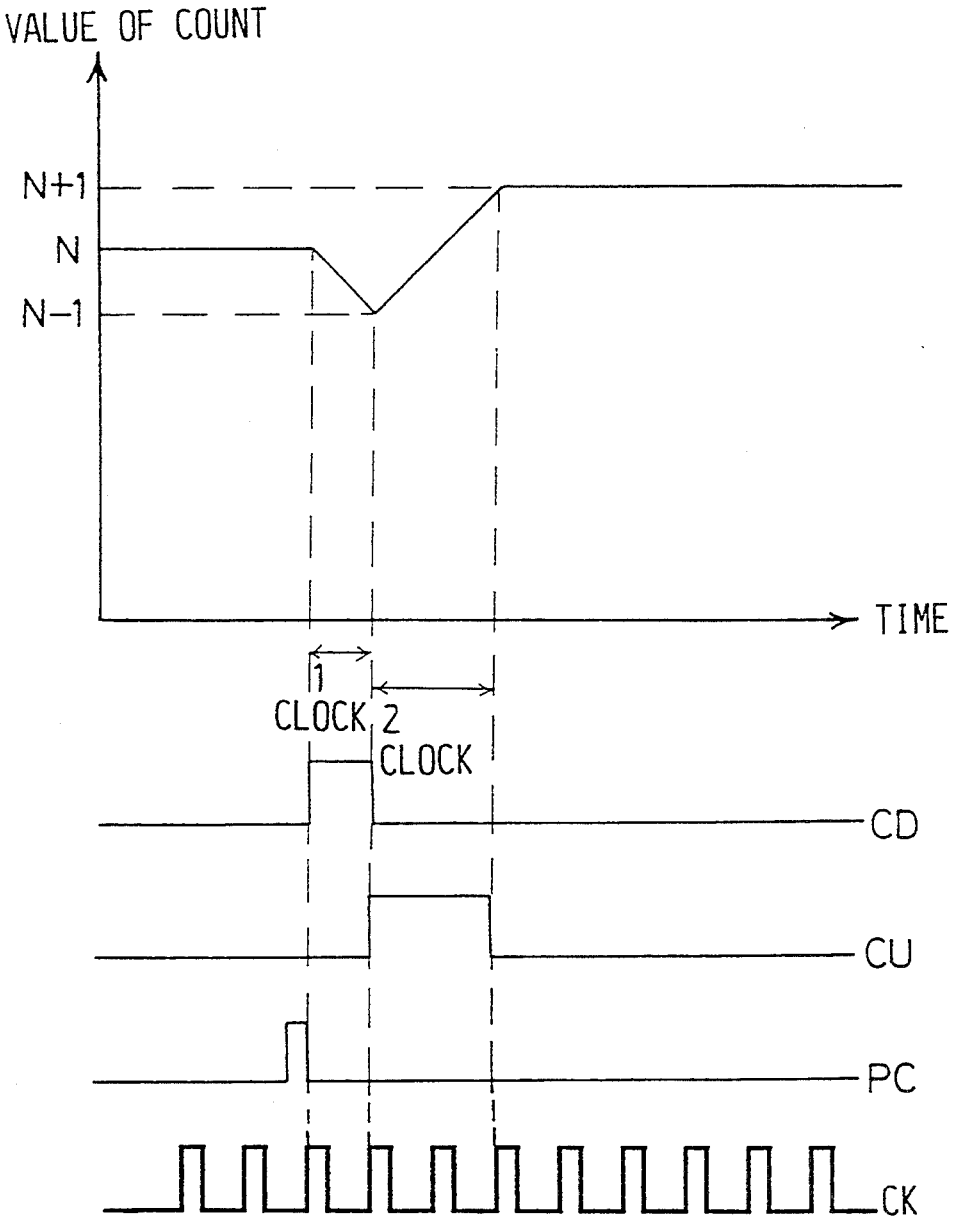
FIG. 4 shows the change of the count value of the counter circuit.
Figure 5:
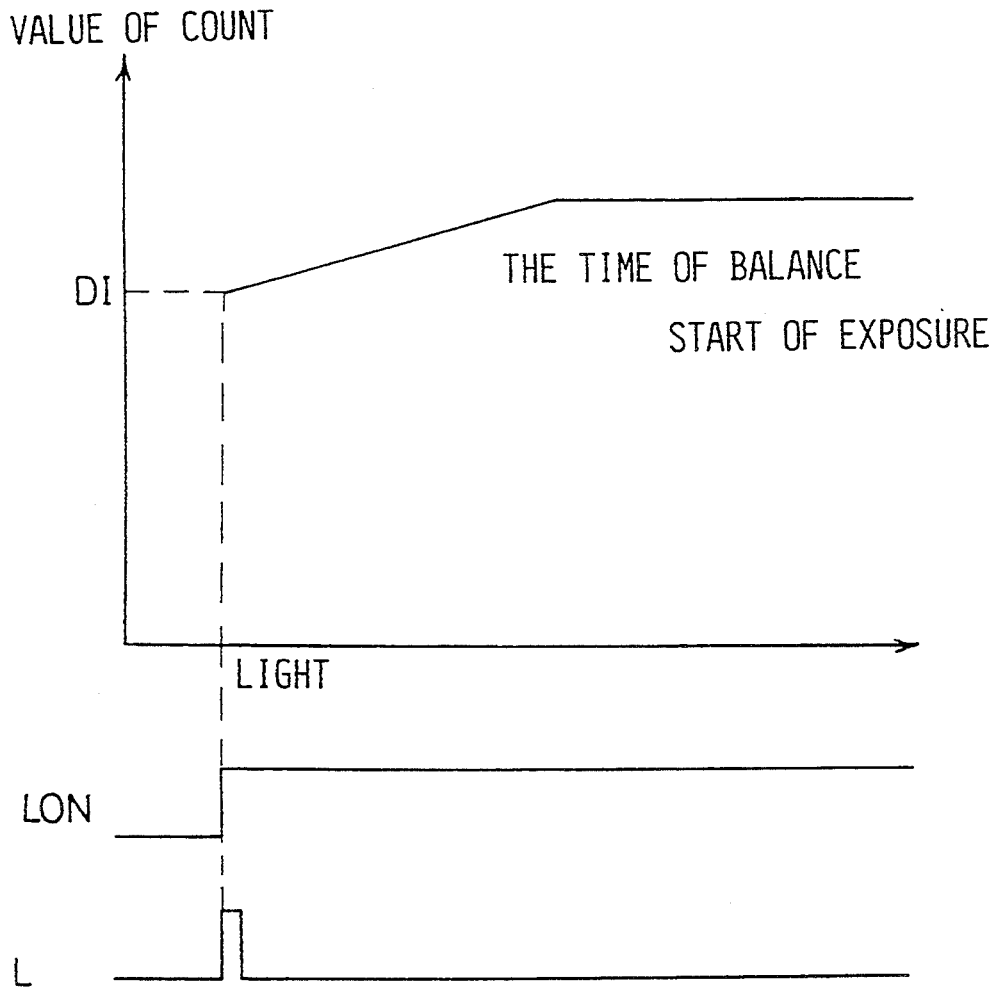
FIG. 5 shows the change of the count value of the counter circuit after the semiconductor laser element begins emitting.

That is, the clock signal of clock circuit 101 is input as a trigger of state circuit 102. As shown in FIG. 4, after the PC signal is input for one clock pulse, the countdown signal (CD signal) is output from the state circuit 102 to the counter circuit 9, and the counter circuit 9 counts down upon being triggered by the clock signal of clock circuit 101.

For two clock pulses after that, until the MON signal is detected, the state circuit 102 outputs the countup signal (CU signal) to the counter circuit 9. The counter circuit 9 counts up once for each triggering by the clock signal of clock circuit 101, within the two clock pulse window.

When a image signal is input from a terminal unit (not shown), a controller (not shown) outputs LON the signal.

When the LON signal is input to the drive circuit 2, the semiconductor laser element 1 begins emitting and the LON signal is input to the initial value set circuit 12 and is converted to load signal (L). The initial value data (DI) set by the dip switch 121 is loaded as a initial count value to counter circuit 9.

As for signal processing circuit 13, the PC signal is output to the control circuit 10 and the control movement is started. The signal processing circuit 13 changes the image signal to a control signal and outputs the control signal to the addition circuit 8. For example, the control signal is the maximum value of the image signal. Semiconductor laser element 1 is driven by the current value which corresponds to the sum of the count value of counter circuit 9 and the control signal.

The clock signal of clock circuit 101 is input to trigger the state circuit 102 as mentioned above and the CD signal is output from the state circuit 102 to the counter circuit 9 for one clock pulse.

The counter circuit 9 lowers the count of the counter circuit by one for each trigger of clock signal of clock circuit 101.

The CU signal is then output by the state circuit 102 to the counter circuit 9 for two clock pulses, until the MON signal is input to the state circuit 102.

The trigger of the clock signal of clock circuit 101 increases the count of the count circuit 9 up to two until the MON signal is input to state circuit 102.

Therefore, the drive current which drives the semiconductor laser element 1 changes gradually, because it is possible for the output count value of counter circuit 9 to change by ±1 count more or less by the up and down control signals for one scan.

That is, the output count value of counter circuit 9 can change by ±1 as shown in FIG. 4, because the clock signal of the same frequency as the state circuit 102 is input from the clock circuit 101 to the counter circuit 9.

For instance, when changing from the CD signal to the CU signal if the MON signal is detected, it lowers the count of the counter by 1 and the output count value is held.

If the MON signal is detected while count up, the output count value at that time is held.

It increases the count of the counter by 1, if the MON signal is not detected and the output count value is held.

The drive current cannot change promptly but changes only gradually, since count-up and count-down control signals can be enabled during the control mode period of each scan.

Next, the exposure movement in the exposure mode is explained. In the exposure movement, the count value of counter 9 which corresponds to the offset current of semiconductor laser element 1 determined by the light strength control movement set forth above and the count values of counter 9 is added to the input image signal by the addition circuit 8 and the sum is converted by D/A conversion circuit 7 into a drive signal, which is an analog voltage. The drive circuit 2 drives the semiconductor laser element 1 based on the drive signal. The laser beam emitted by the semiconductor laser element 1 is deflected by the rotating polygonal mirror 3 through the f-$\theta$ lens 4. The image is thereby formed on the surface of the photosensitive drum 5, which is charged constantly by a charge device (not shown).

By the repeated movement of the laser beam in direction of arrow B, the surface of the rotating photosensitive drum 5 is scanned and exposed at a predetermined speed, and an electrostatic latent image according to the input image signal is formed.

The electrostatic latent image is transferred to paper by a conventional transfer machine (not shown) after the electrostatic latent image is developed by a conventional device (not shown), and the paper is ejected.

When the semiconductor laser element 1 begins emitting, the offset current of the drive signal of semiconductor laser element 1 is set in the same manner as the threshold current of the semiconductor laser element 1, by the dip switch 121, as set forth above.

Therefore, the difference between the offset current set by the dip switch 121 and the actual threshold current level of the semiconductor laser element 1 is equal to the effects of both the change in temperature of the ambient environment and the age deterioration in the laser element. Because the drive signal does not depend on the particular response curve of the individual semiconductor laser element 1, the output intensity of the laser element reaches the predetermined strength level promptly, even when the semiconductor laser element has a large threshold current level.

And, because the output count value of the counter circuit 9 changes only by ±1 count for each control mode period, the control of the drive current can be stabilized and is not easily affected by noise. Therefore, a high-quality image can be formed.

Although the description above contains many specifities, these should not be construed as limiting the scope of the invention but as merely providing illustrations of the presently but preferred embodiment of this invention.

For example, although in this embodiment the output count value of counter circuit 9 changes by at most ±1 count for each control movement, other count value limits may be used. As described above, this embodiment has advantage of that the individual semiconductor laser element's output of light reaches the predetermined strength label more quickly, even when the semiconductor element has a large threshold current level.

What is claimed is:

1. An image exposure apparatus comprising:

a semiconductor laser element having an emitting threshold current value, wherein the semiconductor laser element begins to emit a laser beam when driven at at least the emitting threshold current value;

driving means for driving said semiconductor laser element based on an image signal;

a photosensitive body scanned by a modulated laser beam emitted by said semiconductor laser element to form an exposed image corresponding to said image signal; and driving control means for controlling said driving means based on a monitor signal output by a monitor circuit, said monitor circuit monitoring the laser beam output from said semiconductor laser element during a time period other than when said laser beam scans an area of image formation of said photosensitive body, said driving control means comprising a setting means for setting an initial value of a driving current, said initial value of said driving current being about said emitting threshold current value of said semiconductor laser element, said driving control means adjusting said driving current until said semiconductor laser element emits the laser beam at a predetermined strength value.

2. An image exposure apparatus comprising:

a semiconductor laser element having an emitting threshold current value, wherein the semiconductor laser element begins to emit a laser beam when driven at at least the emitting threshold current value;

a photosensitive body scanned by a modulated laser beam emitted by said semiconductor laser element to form an exposed image corresponding to an image signal;

a comparator for comparing a strength value of said laser beam with a predetermined reference value;

a counter, said counter counting when the strength of said laser beam does not correspond to the predetermined reference value, said counter set to an initial value which corresponds to about said emitting threshold current value;

addition means for adding said image signal and an output of said counter;

driving means for driving said semiconductor laser element based on an output signal from said addition means; and control means for controlling said counter, said control means setting the counter to said initial value upon detection of a control period, said control means incrementing or decrementing said counter based on an output of said comparator.

3. An image exposure apparatus according with claim 2, wherein said counter comprises adjust means for adjusting said initial value.

4. A light intensity control circuit for a semiconductor laser element having an emitting threshold current value, wherein the semiconductor laser element begins to emit a laser beam when driven at at least the emitting threshold current value, the light intensity control circuit comprising:

a laser beam monitor circuit for detecting an intensity of a laser beam emitted by the semiconductor laser element and outputting a monitor signal;

a counter circuit having a predetermined initial value which corresponds to about said emitting threshold current value; and a control circuit for outputting control signals to control the counter circuit based on the monitor signal, said control circuit setting the counter circuit to said initial value upon detection of a control period, said control circuit incrementing or decrementing said counter circuit based on the monitor signal.

5. The light intensity control circuit of claim 4, wherein the laser beam monitor circuit comprises:

a photosensitive diode for outputting a monitor current proportional to the intensity of the laser beam;

an amplification circuit for amplifying the monitor current and converting the monitor current to a monitor voltage; and a comparator circuit for comparing the monitor voltage with a reference voltage, and outputting a comparison signal as the monitor signal.

6. The light intensity control circuit of claim 5, wherein the comparator circuit outputs the comparison signal when the monitor voltage is greater than the reference voltage.

7. The light intensity control circuit of claim 4, wherein the counter circuit comprises:

an initial value set means for setting the initial value;

a counter element for inputting the initial value from the initial value set means upon a loading signal, and for altering the initial value based on the control signals output by the control circuit; and a differentiation circuit for outputting the loading signal based on a laser-on signal.

8. The light intensity control circuit of claim 4, wherein the control circuit comprises:

a clock signal generator circuit; and a state circuit for outputting to the counter circuit a count down signal and a count up signal as the control signals based on the clock signal, the monitor signal and a light intensity control signal.

9. The light intensity control circuit of claim 8, wherein the state circuit outputs the count down signal for a predetermined number of clock pulses after receipt of the light intensity control signal, and thereafter the state circuit outputs the count up signal until receipt of the monitor signal and for at most twice the predetermined number of clock pulses.

10. A method for controlling a light intensity of a laser beam emitted by a semiconductor laser element having an emitting threshold current value, wherein said emitting threshold current value is the current value at which the semiconductor laser element begins to emit a laser beam, the method comprising the steps of:

setting a counter to an initial value which corresponds to about said emitting threshold current value when the semiconductor laser element is turned on;

outputting the laser beam at a current light intensity based on a current value of the counter;

determining a control period other than when the laser beam of the semiconductor laser element is being modulated by an input signal;

determining the current light intensity of the laser beam during the control period;

comparing the determined light intensity of the laser beam to a desired light intensity of the laser beam and generating a comparison signal; and adjusting the current value of the counter based on the comparison signal.

11. The method of claim 10, wherein the counter is adjusted until the comparison signal is generated.

12. The method of claim 11, wherein the adjusting step comprises the steps of:

decreasing the value of the counter by a predetermined number; and increasing the value of the counter by at most twice the predetermined number.

* * * * *